US006516500B2

(12) United States Patent
Ogino et al.

(10) Patent No.: US 6,516,500 B2
(45) Date of Patent: Feb. 11, 2003

(54) PLASTIC CLIPPING DEVICE

(75) Inventors: Nobuaki Ogino, Tokyo (JP); Koichi Sano, Saitama (JP)

(73) Assignee: First Create Co., Ltd., Tokyo (JP)

( * ) Notice: Subject to any disclaimer, the term of this patent is extended or adjusted under 35 U.S.C. 154(b) by 0 days.

(21) Appl. No.: 09/875,051

(22) Filed: Jun. 7, 2001

(65) Prior Publication Data

US 2001/0049863 A1 Dec. 13, 2001

(30) Foreign Application Priority Data

Jun. 7, 2000 (JP) ..... 2000-171255

(51) Int. Cl.[7] ..... A44B 21/00
(52) U.S. Cl. ..... 24/504; 24/499; 24/516
(58) Field of Search ..... 24/265 EC, 504, 24/545, 265 H, 546, 67 CF, 67 R, 568, 570, 455, 67.9, 499; 403/321, DIG. 4, DIG. 9

(56) References Cited

U.S. PATENT DOCUMENTS

| | | | | | |
|---|---|---|---|---|---|
| 4,005,510 | A | | 2/1977 | Noda | |
| 4,141,119 | A | | 2/1979 | Nodo | |
| 4,324,248 | A | * | 4/1982 | Perlin | 24/545 |
| 4,536,924 | A | | 8/1985 | Willoughby | |
| 4,716,634 | A | * | 1/1988 | Fan | 223/91 |
| 5,361,463 | A | * | 11/1994 | Revis | 24/499 |
| 5,388,313 | A | * | 2/1995 | Cameron | 24/265 EC |
| 5,474,572 | A | | 12/1995 | Hayhurst | |
| 5,535,970 | A | * | 7/1996 | Gobbi | 24/557 |
| 5,778,497 | A | * | 7/1998 | Noda | 24/499 |
| 5,884,372 | A | * | 3/1999 | Anscher et al. | 24/3.12 |
| 5,925,064 | A | * | 7/1999 | Meyers et al. | 606/205 |
| 6,260,244 | B1 | * | 7/2001 | Noda | 24/499 |
| 6,263,702 | B1 | * | 7/2001 | Lo | 24/516 |
| 6,266,851 | B1 | * | 7/2001 | Lu | 24/3.12 |
| 6,286,736 | B1 | * | 9/2001 | Angus et al. | 224/236 |
| 6,327,757 | B1 | * | 12/2001 | Noda | 24/499 |

FOREIGN PATENT DOCUMENTS

| | | |
|---|---|---|
| GB | 1 588 907 | 4/1981 |
| TW | 385641 | 3/2000 |

* cited by examiner

*Primary Examiner*—Robert J. Sandy
*Assistant Examiner*—Andre' L. Jackson
(74) *Attorney, Agent, or Firm*—Young & Thompson

(57) ABSTRACT

The present invention is to provide a clipping device made of plastic and which can surely grasp any good regardless a thickness thereof and which comprises a first clamping member 10, a second clamping member 11 rotatably supported at a part of the first clamping member 10, an elastically resilient member 13 integrally formed on a part of the first clamping member 10 and giving the second clamping member 11 a bias force to cause the second clamping member 11 to be moved to a direction whereby the second clamping member 11 to be opened, a coupling piece member 14 integrally formed on a part of the second clamping member 11, and an operation member 15 rotatably supported on a part of the first clamping member 10, and in that by coupling the coupling piece member with the operation member, the first and the second clamping members are fixed to each other.

12 Claims, 4 Drawing Sheets

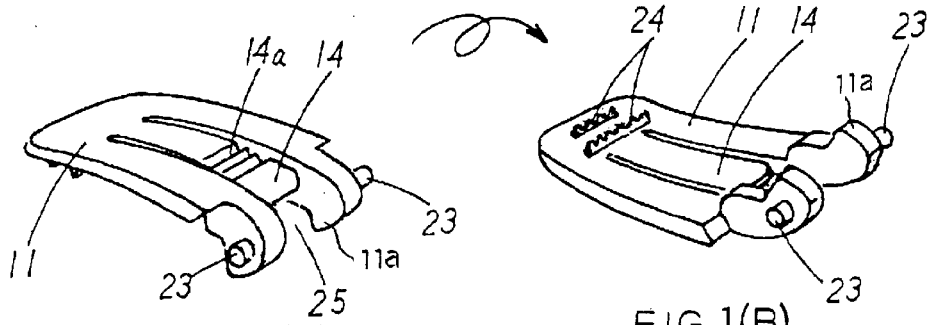
FIG. 1(A)
FIG. 1(B)
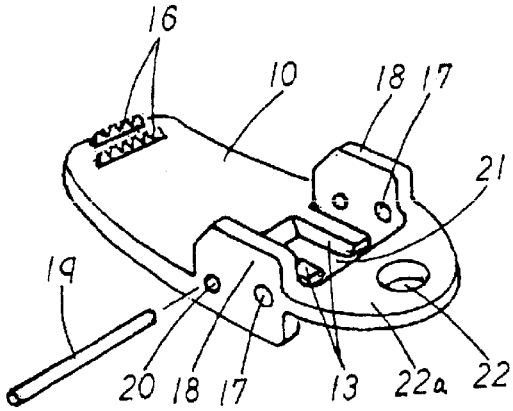
FIG. 1(C)
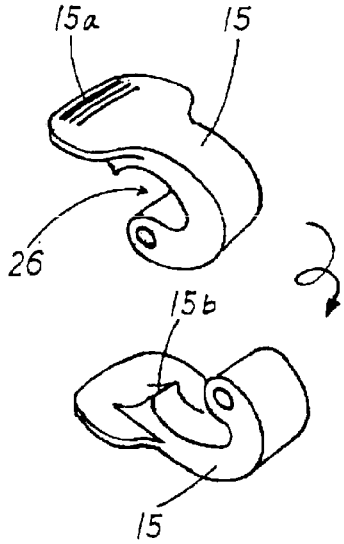
FIG. 1(D)
FIG. 1(E)
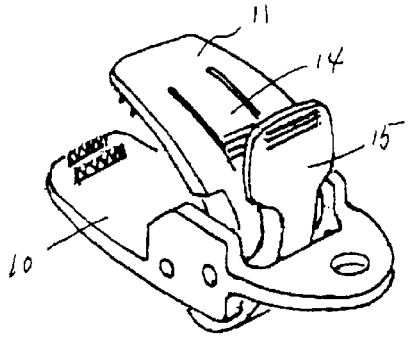
FIG. 2

PLASTIC CLIPPING DEVICE

BACK GROUND OF THE INVENTION

1. Field of the Invention

The present invention relates to a clipping device which can clamp things, especially relates to a plastic clipping device which, for example, is a clipping device for binding a plurality of documents together or a grasping device for surely grasping an object good therewith and for holding it when it is used for as a strap of a movable telephone or of a skiing cap whereby a user being prevented from loosing same.

2. Description of the Related Arts

Generally speaking, a clipping device having a pair of clipping elements made of plastic, metal, wood or the like, which are biased to a direction to make a clamping utilizing a metallic spring or the like, for example, a clothes-pin.

On the other hand, in a separate embodiment of the past, it has been proposed that a clipping device made of an elastic thin plate and having a cross-sectional configuration of being an U-shaped form and an opening portion thereof being caused to be deformed so that a width of the opening portion become narrower than that of a bottom portion thereof whereby the opening portion is to be widened when the clipping device is used to grasp something.

However, the clipping device of the past has the following problems.

For example, the clipping device such as a clothes-pin, since the clipping force thereof to grasp a good, only depends on a biasing force of a spring per se, when the elasticity thereof is deteriorated, the grasping force thereof also reduced, accordingly, so that it cannot surely grasp a good causing the good to be dropped away.

On the other hand, the past clipping device as mentioned above, comprises a remarkable numbers of part elements reducing a process for producing same in a complicated one.

And further, when a thickness of a good to be grasped is varied, it cannot surely grasp the good and thus when a good having a thickness lower than a predeterminde thickness there would exist a problem in that the good would be fallen out from the clipping device.

Therefore, the object of the present invention is to overcome the above-mentioned problems in the past so as to provide a clipping device made of plastic and which can surely grasp any good regardless a thickness thereof.

Another object of the present invention, is to provide a sophisticated plastic clipping device comprising less number of the part elements comparing with those of the past one as well as having a difficulty to be in malfunction thereof.

And a separate object of the present invention is to provide a plastic clipping device which can be easily operated only by a single hand of a person.

SUMMARY OF THE INVENTION

To overcome the above-mentioned past problems, the present invention has basically a technical construction, as follows.

Note that a first aspect of the clipping device of the present invention comprises a first clamping member, a second clamping member rotatably supported at a part of the first clamping member, an elastically resilient member integrally formed on a part of the first clamping member and for giving the second clamping member a bias force to cause the second clamping member to be moved to a direction whereby the second clamping member moving away from the first clamping member, a coupling piece member integrally formed on a part of the second clamping member, and an operation member rotatably supported on a part of the first clamping member, and wherein the coupling piece member and the operation member being coupled to each other so that a mutual positional relationship between the first and the second clamping members is fixed.

In the present invention, it is further characterized in that the elastically resilient member and the second clamping member are abutted with each other through a cam member provided in the vicinity of a portion at which the second clipping member being rotatably supported.

Further in the present invention, the clipping device is characterized in that the cam member having a configuration in that the cam member causing the elastically resilient member to be gradually deformed as an opening angle formed between the first and the second clamping members becoming smaller.

In addition to the above-mentioned, the clipping device is characterized in that connection mechanisms, for example, a connection grooves, with which the coupling piece member and the operation member being coupled to each other, being provided on a part of a surface of the coupling piece member and on a movable tip end portion of the operation member and further wherein the connection mechanisms comprising a connecting projection and a connecting groove.

Note that, in the present invention, at least one connecting groove which can be coupled with the moving tip end of the operation member, being provided on a part of a surface of the coupling piece member.

In order to overcome the above-mentioned problems in the past, since the clipping device of the present invention is so configured that it is comprising a first clamping member, a second clamping member rotatably supported at a part of the first clamping member, an elastically resilient member integrally formed on a part of the first clamping member and for giving the second clamping member a bias force to cause the second clamping member to be moved to a direction whereby the second clamping member moving away from the first clamping member, a coupling piece member integrally formed on a part of the second clamping member, and an operation member rotatably supported on a part of the first clamping member, and wherein the coupling piece member and the operation member being coupled to each other so that a mutual positional relationship between the first and the second clamping members is fixed, it can easily fixedly grasp goods each having various kinds of thickness, respectively.

BRIEF EXPLANATION OF THE DRAWINGS

FIGS. 1(A) to 1(E) show, perspective views of the respective part elements separated from one embodiment of a clipping device of the present invention, respectively.

FIG. 2 is a perspective view of a completely assembled clipping device of one embodiment of the present invention and which shows a condition in that the clamping elements thereof being opened.

DETAILED EXPLANATION OF THE PREFERRED EMBODIMENTS

A specific embodiment of a clipping device of the present invention will be explained with reference to the attached drawings, hereunder.

Figure 3:
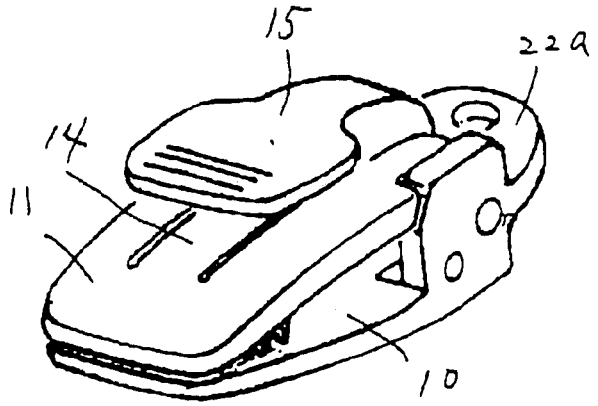
FIG. 3 is a perspective view of a completely assembled clipping device of one embodiment of the present invention and which shows a condition in that the clamping elements thereof being closed.

As mentioned above, FIGS. 1(A) to (E) are perspective views of the respective part elements separated from one embodiment of a clipping device of the present invention, respectively, and FIG. 2 is a perspective view of a completely assembled clipping device of one embodiment of the present invention and which shows a condition in that the clamping elements thereof being opened while FIG. 3 is a perspective view of a completely assembled clipping device of one embodiment of the present invention and which shows a condition in that the clamping elements thereof being closed.

As apparent from these drawings, the clipping device of the present invention comprises a first clamping member 10, a second clamping member 11 rotatably supported at a part of the first clamping member 10, an elastically resilient member 13 integrally formed on a part of the first clamping member 10 and giving the second clamping member 11 a bias force to cause the second clamping member 11 to be moved to a direction whereby the second clamping member 11 to be opened, a coupling piece member 14 integrally formed on a part of the second clamping member 11, and an operation member 15 rotatably supported on a part of the first clamping member 10, and in that by coupling the coupling piece member with the operation member, the first and the second clamping members are fixed to each other by being attached to each other.

The first clamping member 10 is provided with a slip-preventing projection portion 16 at a tip portion thereof as shown in FIG. 1(C), as well as provided with a pair of shoulder portions 18 at both ends portion in a width direction thereof and on each of which a hole 17 is provided, respectively, so as to rotatably support the second clamping member 11.

Further, on each one of the shoulder portions 18, there is provided with a hole 20 for passing through a pin 19 to support the operation member 15.

In this embodiment, the hole 17 and the hole 20 are arranged thereon in a parallelism to each other and the hole 17 is provided at a portion which is relatively and minimally upper portion of a portion at which the hole 20 is provided.

And further, a cut out portion 21 is provided at a portion between the pair of the shoulder portions 18 and inside this cut out portion 21, the operation member 15 is rotatably supported by the pin 19, for example.

On the other hand, in the cut out portion 21 of the first clamping member 10, for example, at least one elastically resilient member 13 is integrally formed on a predetermined portion of the cut out portion 21 thereof.

In addition to this, in the clipping device of the present invention, at an rear end portion of the first clamping member 10, there is provided with a connecting portion 22*a*, being provided with a connecting hole 22 through which a stripe is attached.

The connecting portion 22*a* can be omitted when the clipping device of the present invention is used for grasping papers, documents or the like.

In the embodiment of the present invention, a pair of the elastically resilient members 13 can be provided at both end side portions in a widthwise direction of the cut out portion of the first clamping member 10.

More over, in the embodiment of the present invention, the slip-preventing projection portion 16 which is provided at a tip portion of an inside surface of the first clamping member 10 can be replaced with a separate slip-preventing member made of a rubber, for example, or made of a separate material having a high abrasion co-efficiency.

On the other hand, as shown in FIGS. 1(A) and 1(B), the second clamping member 11 is provided with a rotatable center axis 23 at one end portion thereof and with a slip-prevention projecting portion 24 at a tip portion of inside surface of the second clamping member 11.

In this embodiment, the rotatable center axis 23 is integrally formed with the second clamping member 11 but it may be formed with a separate material.

Further, an opening portion 25 is provided at a center portion in a widthwise direction of the second clamping member 11 and inside the opening portion 25, the coupling piece member 14 which can be coupled with the operation member 15 is provided.

Moreover, at the end portion of the second clamping member 11 on which the rotatable center axis 23 being provide, a cam portion 11*a* which can contact to the elastically resilient members and further in the embodiment of the present invention, the slip-prevention projecting portion 24 can be replaced with a relatively large sized sheet made of a material having a high abrasion co-efficiency.

On the other hand, as shown in FIGS. 1(D) and 1(E), the operation member 15 is rotatably supported on the shoulder portion 18 which is a part of the first clamping member 10 with a pin 19 and thus the operation member 15 can be rotated with respect to the pin 19 as a center of a circle.

Further, the pin 19 can fix the operation member 15 on the shoulder portion 18 by inserting the pin 19 into the hole 20 from outside surface of the shoulder portion 18.

On the other hand, the operation member 15 can make an coupling with the coupling piece member 14 or de-coupling therewith by being rotated around the center axis as a center of the movement.

The operation member 15 is provided with a concaved portion 26 inside surface thereof and thus a overall configuration of the operation member 15 has a curved shape and when both tip portions of the first and the second clamping members 10 and 11 are contacted to each other, the configuration of the operation member 15 shows the similar configuration formed by the second clamping member 11.

Further, the operation member 15 is provided with an operating portion 15*a* to which a finger of a person can be contacted, at a tip end portion of an outer surface of the operation member 15 an also is provided with a coupling projection portion 15*b* to be coupled with the coupling grooves 14*a* at an inner surface of the operation member 15.

Moreover, in the embodiment of the present invention, the first and the second clamping members 10 and 11 as well as the operation member 15 can be made of an engineering plastic or the like.

Figure 4:
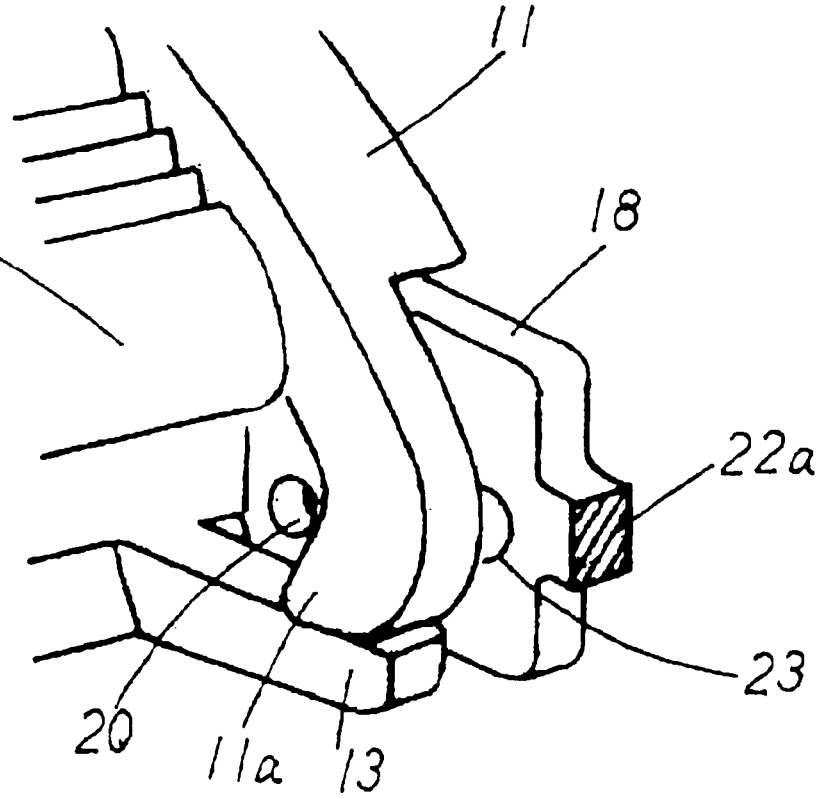
FIG. 4 illustrates a relationship between a cam member 11a of the second clamping member 11 and an elastically resilient member 13.

FIG. 4 shows a relationship between the cam member 11*a* of the second clamping member 11 and the elastically resilient members 13.

And FIG. 4 shows a condition in which the second clamping member 11 is opened and thus the cam portion 11*a* is slightly attached to a top surface of the elastically resilient members 13 and therefore, the second clamping member 11 is slightly biased therefrom.

Figure 5:
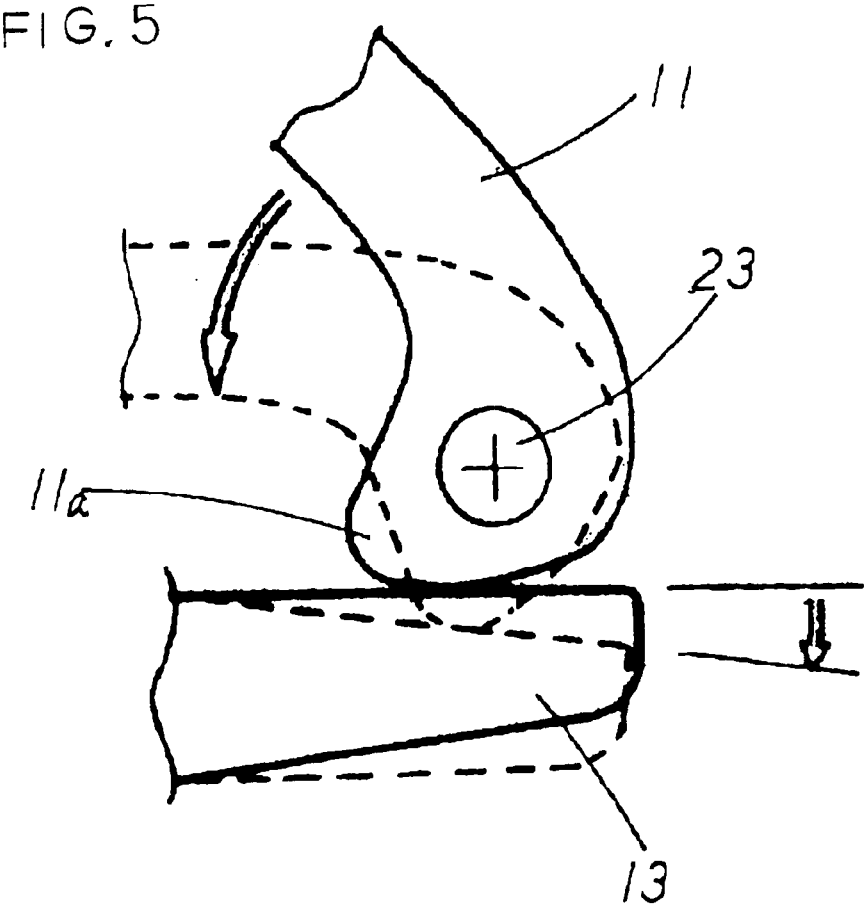
FIG. 5 is a drawing illustrating a relationship between a cam member 11*a* and an elastically resilient member 13.

On the other hand, as shown in FIG. 5, the cam portion 11*a* is configured so that a radius of the cam portion 11*a* is gradually elongated in a direction to the rotation with respect to the rotational axis 23 as a center portion of the rotation, and thus when the operation member 15 is activated, as the tip portion of the second clamping member 11 is closed, the cam portion 11*a* gradually deforms the elastically resilient members 13.

By doing this, the second clamping member 11 receives a biasing force gradually increased as the second clamping member 11 is closed.

On the other hand, when the coupling of the operation member 15 is released, the second clamping member 11 is opened due to the cam effect of the second clamping member and the biasing force generated by the elastically resilient members 13.

Note that, on a part of a surface of the coupling piece member 14, there is provided a coupling groove 14*a* which can couple with a movable tip end portion of the operation member 15 and one or a plurality of the coupling groove 14*a* may be provided thereon.

Further, at a movable tip end portion of the operation member 15, a coupling projection portion 15*b* which can be coupled with the coupling groove 14*a*, is provided.

Moreover, the coupling piece member 14 is provided inside the opening portion 25 provided on the second clamping member 11, while one or plurality of the coupling grooves 14*a* can be arranged on a surface of the coupling piece member 14, along a longitudinal direction thereof.

In another embodiment of the present invention, one or a plurality of coupling projection portions can be provided on the surface of the coupling piece member 14, instead of the coupling groove 14*a* but in this case, on the operation member 15, which can couple with this coupling piece member 14, one or a plurality of coupling grooves should be provided.

A specific operation of the clipping device of the present invention will be explained hereunder with referring to FIGS. 6 to 9, but as explained above, the present invention is not restricted only to this embodiment and thus it is true that the present invention can apparently include another embodiment in that only one coupling groove is provided.

Figure 6:
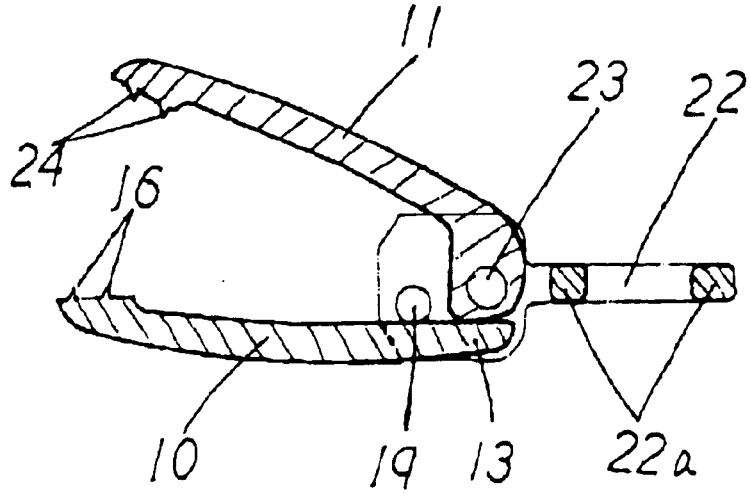
FIG. 6 is a cross-sectional view in a longitudinal direction of a clipping device of the present invention in that both clamping elements being opened to each other.
Figure 8:
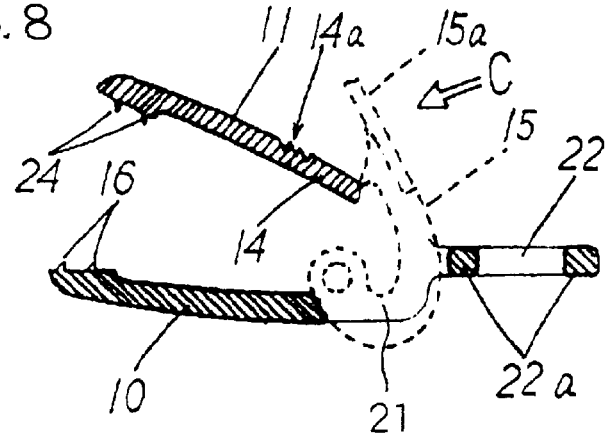
FIG. 8 is a cross-sectional view in a longitudinal direction of a clipping device of the present invention in that a relationship between the coupling piece member and the operation member when both clamping elements being opened to each other.

Note that FIGS. 6 and 8 show conditions in that the clamping members of the clipping device of the present invention is opened.

Under this situation, the clipping device of the present invention shows the maximum opened angle so that a goods to be grasped can be entered into this opening portion.

After when the clipping device had grasped the good therein, with holding over all portion of the clipping device, the operating portion 15*a* of the operation member 15, is pushed by a finger of a user thereof along an arrow direction C.

Figure 9:
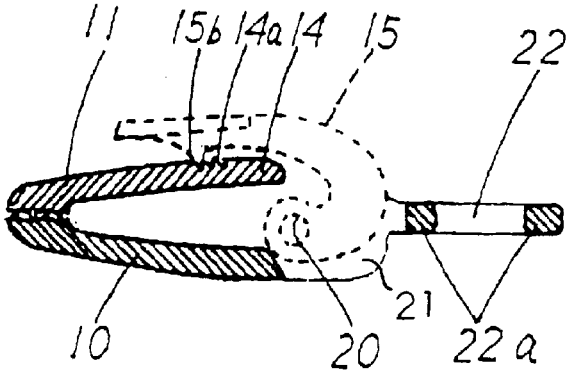
FIG. 9 is a cross-sectional view in a longitudinal direction of a clipping device of the present invention in that a relationship between the coupling piece member and the operation member when both clamping elements being closed to each other.

By doing this, the coupling groove 14*a* of the coupling piece member 14 and the coupling projection portion 15*b* of the operation member 15 are coupled with each other as shown in FIG. 9.

Since a plurality of the coupling grooves 14*a* are provided, depending upon which one of the coupling grooves 14*a* coupling with the coupling projection portion 15*b*, a gap formed between the tip end portions of the first and the second clamping members 10 and 11 or a pressing force generated therebetween can be optionally adjusted and thus the opening portion formed between the first and the second clamping members 10 and 11, can be fixedly maintained at a respective position to meet with various thickness which a good might have.

Figure 7:
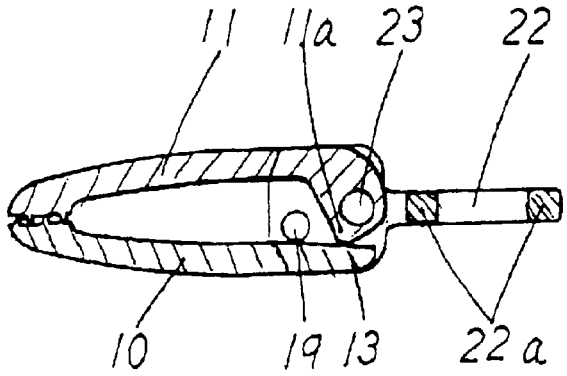
FIG. 7 is a cross-sectional view in a longitudinal direction of a clipping device of the present invention in that both clamping elements being closed to each other.

FIGS. 7 and 9 show a condition in that the tip end portions of the first and the second clamping members 10 and 11 are directly contacted with each other so that the opening portion is fixed at a closed situation when the operation member 15 of the clipping device had further been pushed in the same direction as mentioned above.

As shown in FIG. 7, when the second clamping member 11 is closed, the cam portion 11*a* deforms the elastically resilient members 13 causing to generate a biasing force which make the second clamping member 11 opened.

On the other hand, as shown in FIG. 9, since the rotational center of the second clamping member 11 and the rotational center of the operation member 15 are different from each other, and further a tip end portion of the coupling piece member 14 is bent to a direction to which the coupling piece member 14 had been pushed, the coupling groove 14*a* of the coupling piece member 14 and the coupling projection portion 15*b* of the operation member 15 are coupled with each other.

As mentioned above, the clipping device of the present invention can set and fix the value of the opening angle formed between the first and the second clamping members 10 and 11, optionally by utilizing a plurality of the coupling grooves 14*a* so that the opening gap formed between the first and the second clamping members 10 and 11, can be fixedly maintained at various thickness values.

On the other hand, as shown in FIGS. 6 to 9, when a strap, thread or the like is connected to the connecting portion 22*a*, overall the clipping device can be positioned at any optional portion or position and thus it can be used as a cap fastener, a clothes-pin, a strap for movable telephone or the like.

Further, when the device is used for a clipping device for grasp documents or papers, no such connecting portion 22*a* is required and thus for this purpose, the clipping device of the present invention may not be provided with such connecting portion 22*a*.

In these embodiments, the connecting portion 22*a* has a circular cross-sectional configuration but it can be a rectangular or oval configuration.

The present invention can be modified within the scope of the technical conception as mentioned above, without limiting the invention only to the above-mentioned embodiments.

In the present invention, a first effect thereof is such that the clipping device thereof can surely and easily grasp and fix any kinds of goods regardless the thickness of the goods to be grasped.

The reason thereof is such that by changing the coupling position between the operation member 15 and the coupling piece member 14, a gap formed between the first and the second clamping members can be varied and adjusted at a suitable distance for grasping a certain good having a certain thickness.

And further, since the clipping device is made of plastic, the coupling piece member 14 is expected to be elastically deformed so that the gap formed therebetween can be automatically adjusted.

More over, the clipping device of the present invention comprises only a pair of the clamping members, the operation member 15 and an axis pin and the number of the part elements is very small and no spring member or the like is necessary.

Therefore, the clipping device has less chance to malfunction and the manufacturing steps can be remarkably simplified so as to make the production cost cheap.

A second effect of the present invention is such that the clipping device of the present invention can be easily used and operated by simply holding same by a single hand of the user and thus the user is not required to use both hands thereof in using this clipping device as well as a size of the clipping device can be freely changed depending upon an application field thereof.

What is claimed is:

1. A plastic clipping device which comprises:

a first clamping member;

a second clamping member rotatably supported at a part of said first clamping member;

said first clamping member being provided with end side portions in a widthwise direction of a cutout portion of said first clamping member;

a pair of elastically resilient members provided on said end side portions of said first clamping member and located at a position in the vicinity of a portion at which said second clamping member being rotatably supported, and for giving said second clamping member a bias force at a portion thereof located in the vicinity of a position at which said second clamping member being rotatably supported, to cause said second clamping member to be moved to a direction whereby said second clamping member moving away from said first clamping member;

a coupling piece member integrally formed on a part of said second clamping member; and an operation member rotatably supported on a part of said first clamping member;

and wherein said coupling piece member and said operation member being coupled to each other so that a mutual positional relationship between said first and said second clamping members is fixed.

2. A plastic clipping device according to claim 1, wherein said coupling piece member being integrally provided within an opening formed on said second clamping member.

3. A plastic clipping device according to claim 1, wherein said operation member being rotatably supported on a part of said first clamping member and wherein said first clamping member being swung with respect to a rotation center portion, an engagement or a disengagement formed between said operation member and said coupling piece member being carried out.

4. A plastic clipping device according to claim 1, wherein said operation member having a curved portion formed between both end portions thereof.

5. A plastic clipping device according to claim 1, wherein said elastically resilient member and said second clamping member being abutted with each other through a cam member provided in the vicinity of a portion at which said second clamping member being rotatably supported.

6. A plastic clipping device according to claim 5, wherein said cam member having a configuration in that said cam member causing said elastically resilient member to be gradually deformed as an opening angle formed between said first and said second clamping members becoming smaller.

7. A plastic clipping device according to claim 1, wherein connection mechanisms with which said coupling piece member and said operation member being coupled to each other, being provided on a part of a surface of said coupling piece member and on a movable tip end portion of said operation member and further wherein said connection mechanisms comprising a connecting projection and a connecting groove.

8. A plastic clipping device according to claim 7, wherein at least one connecting groove which can be coupled with said moving tip end of said operation member, being provided on a part of a surface of said coupling piece member.

9. A plastic clipping device according to claim 7, wherein at least one connecting projection which can be coupled with said connecting groove of said coupling piece member, being provided on a movable tip end portion of said operation member.

10. A plastic clipping device according to claim 7, wherein at least one connecting projection which can be coupled with said moving tip end of said operation member, being provided on a part of a surface of said coupling piece member.

11. A plastic clipping device according to claim 7, wherein at least one connecting groove which can be coupled with said connecting projection of said coupling piece member, being provided on a movable tip end portion of said operation member.

12. A plastic clipping device according to claim 7, wherein a plurality of said connecting grooves being arranged on a surface of said coupling piece member, in parallel with each other and along a longitudinal direction of said coupling piece member.

* * * * *